US007474231B2

(12) United States Patent
Sohr

(10) Patent No.: US 7,474,231 B2
(45) Date of Patent: Jan. 6, 2009

(54) RADIO COMMUNICATIONS FOR VEHICLE SPEED ADJUSTMENT

(75) Inventor: Juergen Sohr, Nuremberg (DE)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 209 days.

(21) Appl. No.: 11/485,157

(22) Filed: Jul. 12, 2006

(65) Prior Publication Data

US 2008/0021600 A1 Jan. 24, 2008

(51) Int. Cl.
*G08G 1/16* (2006.01)

(52) U.S. Cl. ..... 340/903; 340/435; 340/464; 701/301

(58) Field of Classification Search ..... 340/435, 340/436, 937, 903, 904, 466, 464; 700/300, 700/301; 701/45, 300, 301; 180/271, 250, 180/275; 348/143, 148, 161; 342/70–72
See application file for complete search history.

(56) References Cited

U.S. PATENT DOCUMENTS

| | | | | |
|---|---|---|---|---|
| 5,295,551 A | | 3/1994 | Sukonick | 180/167 |
| 5,486,808 A | * | 1/1996 | Nejdl | 340/464 |
| 5,781,119 A | | 7/1998 | Yamashita et al. | 340/903 |
| 5,905,434 A | * | 5/1999 | Steffan et al. | 340/464 |
| 6,243,685 B1 | * | 6/2001 | Welch et al. | 704/276 |
| 6,553,285 B1 | * | 4/2003 | Bahmad | 701/1 |
| 7,123,168 B2 | * | 10/2006 | Schofield | 340/937 |
| 7,151,997 B2 | * | 12/2006 | Uhlmann et al. | 701/208 |
| 2004/0138809 A1 | | 7/2004 | Mukaiyama | 701/200 |
| 2007/0135989 A1 | | 6/2007 | Hengst | 701/117 |

FOREIGN PATENT DOCUMENTS

JP 2006293615 A 10/2006

OTHER PUBLICATIONS

PCT/US2007/015835, Jan. 25, 2008, International Search Report.

* cited by examiner

*Primary Examiner*—Anh V La

(57) ABSTRACT

A method is provided comprising the following steps. A vehicle receives by radio from another vehicle an indication of speed of said another vehicle. The vehicle determines its own speed. A speed adjustment is automatically determined to be effected by said another vehicle so as to control relative speed of the vehicles. A speed adjustment request is transmitted by radio to said another vehicle.

9 Claims, 4 Drawing Sheets

RADIO COMMUNICATIONS FOR VEHICLE SPEED ADJUSTMENT

FIELD OF THE INVENTION

The present invention relates to communications, in particular radio communications.

DESCRIPTION OF THE RELATED ART

On freeways and motorways, such as german autobahns, trucks disrupt smooth and safe traffic flow. A lorry that slowly overtakes another lorry, particularly on a two-lane stretch of road, can be a significant hazard to faster moving vehicles. In Germany such situations are known as "Elefantenrennen" (elephant races).

SUMMARY OF THE INVENTION

The inventor found a way to reduce the chances of, or avoid, vehicles overtaking slowly.

An example of the present invention is a method comprising the following steps. A vehicle receives by radio from another vehicle an indication of speed of said another vehicle and the vehicle determines its own speed. At least one speed adjustment is automatically determined, that is to be effected by said another vehicle so as to control relative speed of the vehicles. A speed adjustment request is transmitted by radio to said another vehicle.

BRIEF DESCRIPTION OF THE DRAWINGS

An embodiment of the present invention will now be described by way of example and with reference to the drawings, in which.

DETAILED DESCRIPTION

The automated speed control system that is on-board a truck will first be described. After this, we describe system initialisation. A scenario is then described of one truck encountering another leading to a decision whether to overtake or align speeds. After this, the overtaking operation is described. This is followed by a description of the other option, namely speed alignment.

On-Board Equipment

Figure 1:
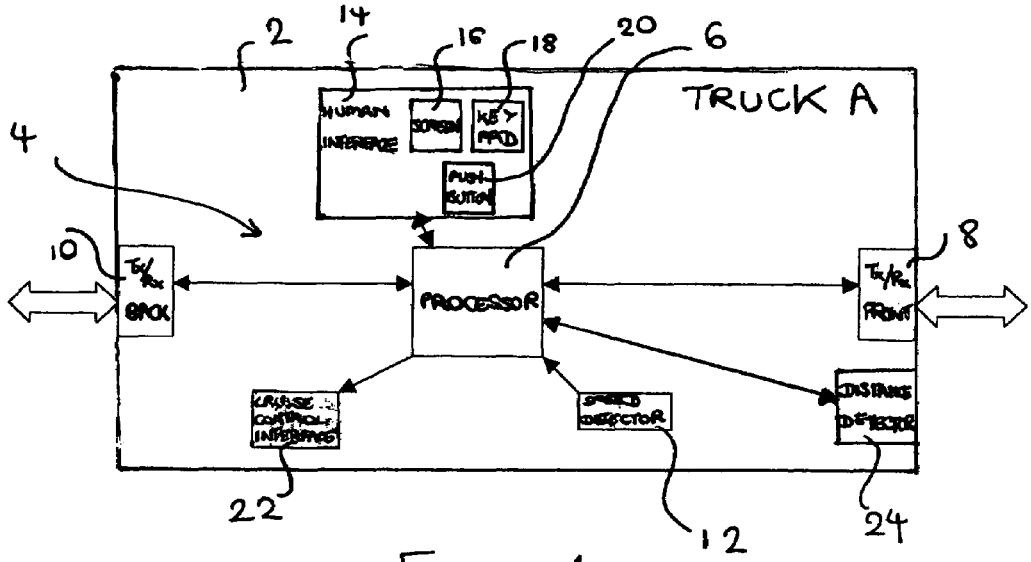
FIG. 1 is a diagram illustrating a truck according to an embodiment of the present invention.

As shown in FIG. 1, the truck 2, sometimes denoted truck A, includes an automated speed control system 4. The control system 4 consists of a processor 6 which is connected to a radio transmitter-receiver unit 8 mounted on the front of the truck 2 and a corresponding radio transmitter-receiver unit 10 mounted on the back of the truck 2. The transmitter-receiver units 8,10 may use Bluetooth wireless protocol, which operates at 2.4 GHz, to communicate with other transmitter-receiver units (not shown) of other trucks (not shown in FIG. 1). The radio range of the transmitter-reciever units is approximately 100 metres.

The control system 4 also includes an accurate truck speed detector 12, such as a Global Positioning System, GPS, module. This regularly provides the processor 6 with measurements of truck speed.

The control system 4 also includes an electronic human interface 14 to the processor 6. The interface 14 includes, e.g., a visual display screen 16 and a keypad 18 that are mounted on the dashboard (not shown) of the truck 2. The interface 14 may also include a single push-button 20, which is an "ok" acknowledgement key. The push-button 20 is located near or on the steering wheel (not shown), so that the push-button 20 can be readily pressed by a driver (not shown) whilst driving. The interface 14 may also include a sounder (not shown) that emits a short "beep" tone to attract the driver's attention.

The control system 4 also includes an interface 22 from the processor 6 to the cruise control system (not shown) of the truck 2. This enables processor-controlled adjustment of cruise control speeds, subject to driver approval.

The control system 4 also includes a distance detector 24 mounted on the front of the truck 2. The distance detector 24 uses radar to determine distance to first vehicle, or other large object, that is within range in front. The distance detector 24 regularly provides distance data to the processor 6.

Figure 2:
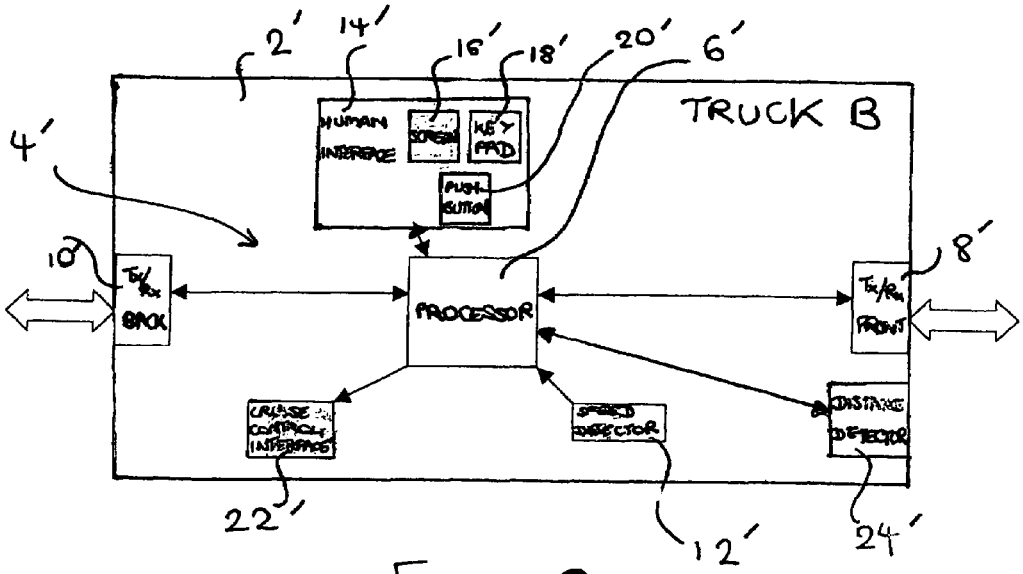
FIG. 2 is a diagram illustrating a further truck as shown in FIG. 1.

Another truck 2', sometimes denoted truck B, also having equipment as described above, is shown in FIG. 2. For clarity in the subsequent description, the reference symbols to equipment on board this further truck 2', truck B, are denoted with a prime (') symbol.

System Initialisation

Before use, the control system 6 is configured by data being input by the driver via the human interface 14. The data is of, for example:

a truck identifier, namely its license plate number,
favoured speed range,
maximum speed set by law,
length of truck (e.g. short or long),
distance to destination, and
weather conditions (rain/snow/good).

This data is referred to below as configuration data.

Truck Encounter

Figure 3:
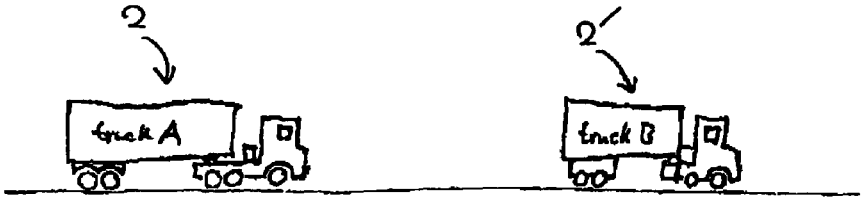
FIG. 3 is a diagram illustrating figuratively two trucks interacting, each truck being as shown in FIG. 1.

Consider the scenario shown in FIG. 3, where there are two trucks 2,2', each as described above, that are getting closer together.

The control systems 4,4' of each of the two trucks have been initialised with appropriate data from their drivers as discussed above. Both trucks are travelling at more than 60 Kilometers/hour (Km/h) such that the control systems 4,4' of each become active. On each truck, the speed detector 12,12' regularly delivers speed information to the processor 6,6'.

On each truck 2,2', the radar distance detector 24,24' acts to regularly determine distance to the first obstacle in front that is less than 100 metres away. For example, this can be distance to the next vehicle in front, when that vehicle is less than 100 metres in front. The radar distance detector 24,24' regularly delivers distance information to the processor 6,6'.

Figure 4:
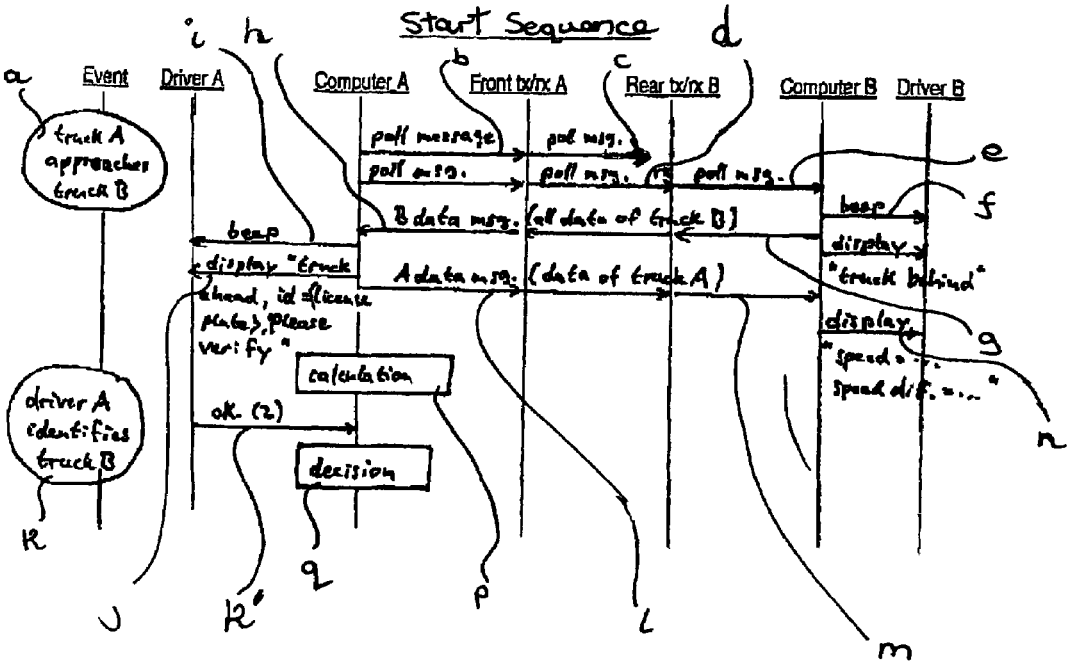
FIG. 4 is a message sequence diagram illustrating messaging between the two trucks shown in FIG. 3 in deciding whether to select an overtaking operation or a speed alignment operation.

As shown in FIG. 4, the rear truck 2, which is denoted "truck A", includes a processor 6 denoted "computer A", a front-mounted transmitter-receiver unit 8 denoted "Front tx/rx A", a back-mounted transmitter-receiver unit 10 denoted "Rear tx/rx A", and a human interface 14 denoted "driver A" for interaction with the driver of that truck. In like fashion, the front truck 2' which is denoted "truck B", includes a processor 6' denoted "computer B", a front-mounted transmitter-receiver unit 8' denoted "Front tx/rx B", a back-mounted transmitter-receiver unit 10' denoted "Rear tx/rx B", and a human interface 14' denoted "driver B" for interaction with the driver of that truck.

As shown in FIG. 4, the rear truck 2 approaches (step a) the front truck 2'. The processor of the rear truck 2 periodically sends a polling message (step b) to its front transmitter-receiver unit 8 which transmits the polling message forward (step c) using the known Bluetooth standard for radio communications. When the front truck 2' is close enough to be in Bluetooth range, such a polling message is received (step d) by the rear transmitter-receiver unit 10' of the front truck 2', and forwarded (step e) from that rear transmitter-receiver unit 10' to the processor 6' of the front truck 2'.

The process continues by, in the front truck 2', the processor 6' causing an audible beep to be issued (step f) by the human interface 14' followed by display on the screen 16' of the human interface 14' of an information message "Truck behind". The processor 6' of the front truck 2' then instructs (step g) the sending of a data message to the rear truck 2. The data message is of data about the front truck 2', and includes its configuration data as described above, and its speed. The data message also includes an indicator of whether or not there is a further truck (not shown) in Bluetooth range in front of the front truck 2' and hence determined by that front truck 2' as being in front.

The data message is received by the front transmitter-receiver unit 8 of the rear truck 2 and forwarded (step h) to the processor 6 of the rear truck 2. In consequence, the processor 6 of the rear truck 2 causes an audible "beep" tone to be issued (step i) by the human interface 14 of the rear truck 2. Also, a message to be displayed (step j) on the screen 16 of the human interface 14 of the rear truck of the form "Truck ahead, identity is (licence plate number)—please verify", or the like.

The driver of the rear truck 2 checks (step k) the licence number plate of the front truck 2', then presses (step k) the push-button 20 to confirm that the front truck is correctly identified.

The processor 6 of the rear truck 2 then instructs the sending (step l) of a data message to the front truck 2'. The data message is of data about the rear truck 2 and includes its configuration data as described above, and its speed. The data also includes the detected distance to the front truck 2'. This data is received by the rear transmitter-receiver unit 8' of the front truck 2' and forwarded (step m) to the processor 6' of the front truck 2'. The processor 6' of the front truck 2' then controls the human interface 14' of the front truck to display (step m) a message of the form "speed= . . . , speed difference= . . . " or the like.

At the rear truck 2, the processor 6 calculates (step p) a speed difference threshold value X. The speed difference threshold X is determined dependent upon weather condition, length of the trucks, maximum legal speeds and favoured speed ranges.

The speed difference threshold value X is used by the processor 6 to decide whether to recommend either an overtaking operation on the one hand, or a speed alignment operation on the other hand. For example, if weather is 'good', both trucks are 'long', the speed of the rear truck 2 is less than the legal maximum, and the overlap of favoured speed ranges of the two trucks 2,2' is none or very small, and also no further truck in front of the front truck 2 is detected, then the threshold value X may be selected to be, say, 5 kilometers/hour (km/h). The threshold value X is selected from within a possible range of 2 km/h to 15 km/h.

The processor 6 of the rear truck 2 uses the data of the detected speeds of the two trucks 2,2' and the threshold value X to decide (step q) whether to recommend an overtaking operation or a speed alignment operation. If the speed difference is less than X, speed alignment is recommended. If the speed difference is X or more, overtaking is recommended.

Overtaking Operation

Figure 5:
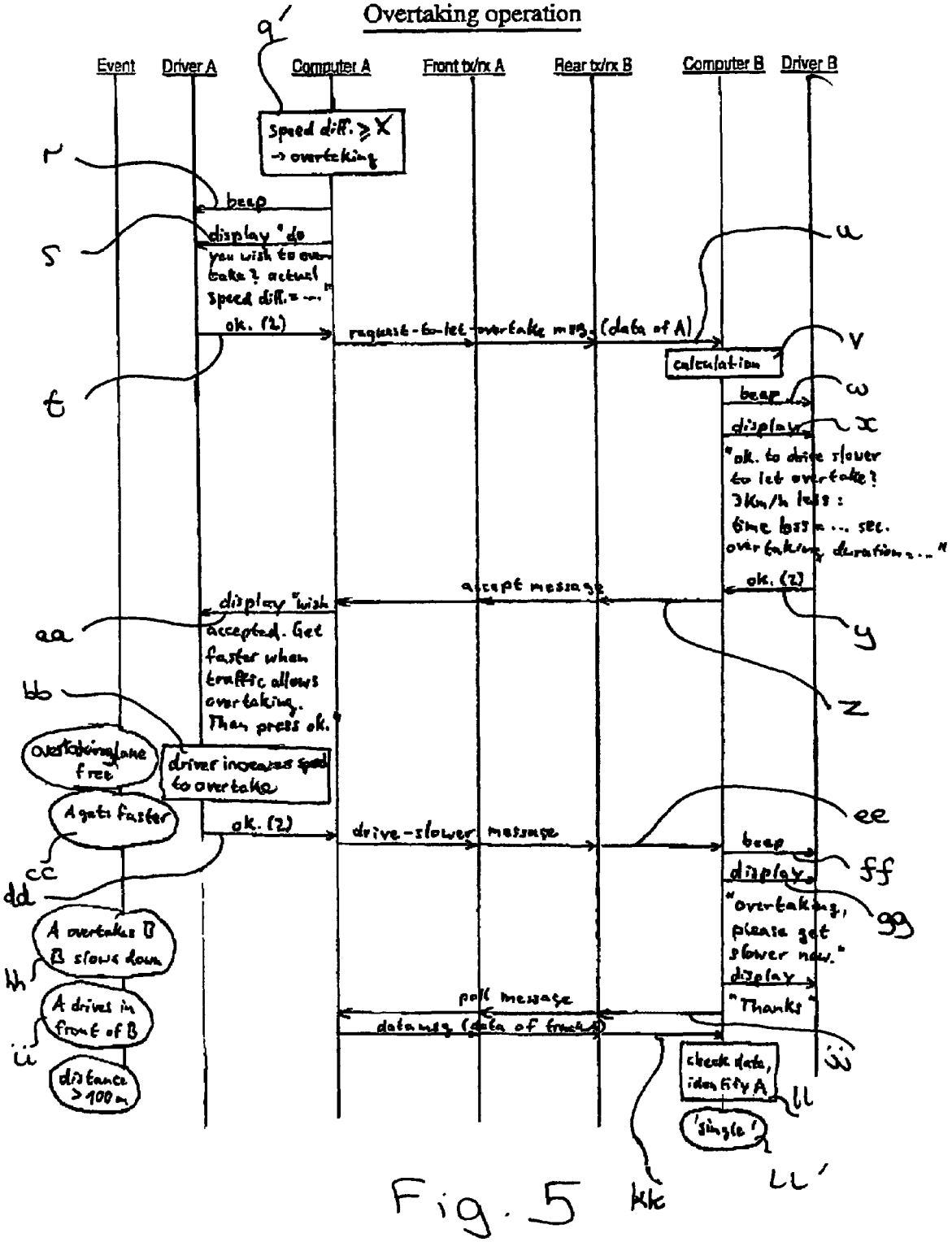
FIG. 5 is a message sequence diagram illustrating the overtaking operation.

As shown in FIG. 5, where the decision is to recommend overtaking (step q), the processor 6 of the rear truck 2 instructs (step r) the human interface to issue an audible "beep" tone. The beep tone is issued and a message displayed (step s) on the human interface 14 of the rear truck 2 of the form "do you wish to overtake? Actual speed difference = . . . " or the like.

The driver decides she/he wishes to overtake, so presses (step t) push-button 20 of the human interface 14 of the rear truck 2 so as to send an affirmation signal to the processor 6. In consequence, the processor 6 formulates and sends (step u) a request-to-let-overtake message that includes data of the rear truck 2, specifically its speed and the speed difference. This message is transmitted via the front transmitter-receiver unit 8 of the rear truck 2 and rear transmitter-receiver unit 10' of the front truck 2' to the processor 6' of the front truck 2'.

The processor 6' of the front truck then uses the rear truck speed and the speed difference in order to calculate (step v) a desired reduction in speed of the front truck 2', the anticipated duration of the overtaking manoeuvre, and the additional journey time to the front truck 2'. This information is passed to the human interface 14' of the front truck 2' and, after a "beep" tone precursor (step w), displayed there (step x) as a message of the form "OK to drive slower to let overtake? 3 km/h less: time loss= . . . sec. Overtaking duration= . . . " or the like.

The driver of the front truck 2' accepts by pressing the push-button 20' in her/his truck 2' causing an affirmation signal to pass (step y) to the processor 6' of the front truck 2'.

This processor 6' reacts by sending (step z) an accept message via the rear transmitter-receiver unit 10' of the front truck 2' and the front transmitter-receiver unit 8 of the rear truck 2 to the processor 6 of the rear truck 2.

The processor 6 of the rear truck 2 reacts by instructing that a message be displayed (step aa) of "wish accepted. Get faster when traffic allows overtaking then press o.k." or the like.

When the overtaking lane becomes free, the driver of the rear truck 2 controls (step bb) an increase in speed (e.g. 3 km/h) by enabling adjustment of his cruise control speed by way of the cruise control interface 22. In consequence, the rear truck 2 gets faster (step cc) the driver of the rear truck 2 then sends (step dd) an affirmation signal to the processor via push-button 20 to indicate the truck is now travelling faster.

The processor 6 of the rear truck 2 then sends (step ee) a drive-slower command message via the front transmitter-receiver unit 8 of the rear truck 2 and the rear transmitter-receiver unit 10' of the front truck 2' to the processor 6' of the front truck 2'.

The processor 6' of the front truck 2' then controls its human interface 14' to emit (step ff) an audible "beep" tone and display (step gg) a message "overtaking, please get slower now" followed by a further message "Thanks", or the like.

The driver of the front truck 2' controls his speed (step hh) by slowing down by the previously indicated amount (e.g. by 3 km/h in this example) whilst the other truck 2 overtakes (step ii).

Truck 2 (truck A) is now the truck in front and truck 2' (truck B) is now the truck at the rear. The processor 6' of truck B sends (step jj) a polling message to truck A via the transmitter-receiver units in between. The processor 6' of truck A receives the message and sends (step kk) its configuration data and current speed in a data message in reply. The processor 6' of truck B receives the data message and identifies truck A (step ll) noting that truck A has detected no further truck in front of itself. The distance between the two trucks thereafter increases, so the overtaken truck (truck B, 2') returns to its original speed. When the distance becomes greater than say 100 metres, the overtaken truck, truck B, no longer detects a truck in front of itself so its processor 6' assumes (step ll') a driving "single" state.

Speed Alignment Operation

Figure 6:
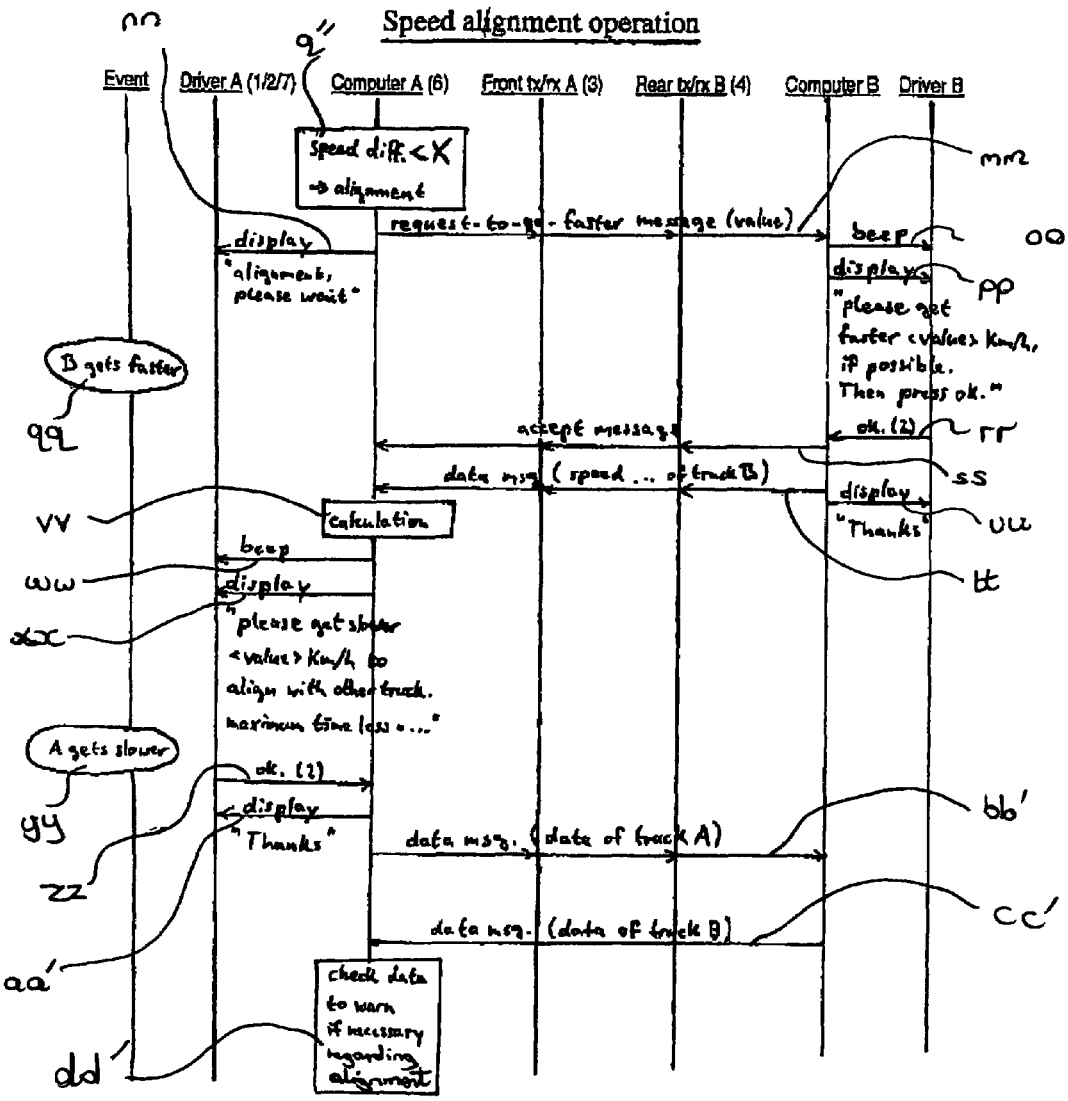
FIG. 6 is a message sequence diagram illustrating the speed alignment operation.

As shown in FIG. 6, where the decision is to recommend speed alignment rather than overtaking, then the processor 6 of the rear truck 2 instructs (step mm) a request to go faster message to be transmitted to the front truck 2' where the message is received and forwarded to the processor 6' of the front truck 2'. The message includes a speed increment value, which we here denote as V. For example V stands for 2 Km/h. The processor of the rear truck 2 instructs its human interface 14 to display (step nn) a message "alignment, please wait" or the like.

The processor 6' of the front truck 2' causes its human interface 14' to emit (step oo) an audible "beep" tone, and display (step pp) a message of the form "please get faster V km/h if possible. Then press ok." or the like. Once this speed increase is increased (step qq) under the control of the driver of front truck 2', its driver presses (step qq) push-button 20' so that an affirmation signal is sent (step rr) from the human interface 14' to the processor 6' of the front truck 2'. In consequence, an "accept" message is transmitted (step ss) by the processor 6' of the front truck 2' so as to reach to the processor 6 of the rear truck 2. A data message is then transmitted (step tt) along the same path so that data of the increased speed of the front truck 2' is reported to the processor 6 of the rear truck 2.

The processor 6' of the front truck 2' instructs the human interface 14' of the front truck 2' to display (step uu) a message "Thanks" or the like.

The processor 6 of the rear truck 2, then (step vv) calculates from the speed values the speed difference for the rear truck 2, and also calculates maximum possible time loss due to the reduction in speed in view of remaining distance to destination, and instructs that the human interface 14 to emit (step ww) a "beep" tone to the driver of the rear truck 2. The processor 6 of the rear truck 2 also causes its human interface 14 to display (step xx) a message of the form "please get slower <value> Km/h to align with other truck. Maximum time loss= . . . " or the like. In the preceding message, <value> Km/h could be, e.g. 2 Km/h. The driver of the rear truck 2 controls its speed to slow down (step yy) by that amount, then presses the push-button 20 to cause an affirmation signal to be sent (step zz) to the processor 6 of the rear truck 2. A message "Thanks" is returned and displayed (step aa') by the human interface 14 in response.

Thereafter a data message is sent (step bb') from the processor 6 of the rear truck 2 via the appropriate transmitter-receiver units 8,10' to the processor 6' of the front truck 2', informing of the rear truck's speed.

A corresponding data message is sent (step cc') from the processor 6' of the front truck 2' via the appropriate transmitter-receiver units 10', 8 to the processor 6 of the rear truck 2, informing of the front truck's speed. In the rear truck, a check is made (step dd') that the speeds are still aligned, and if not, further alignment steps (not shown), similar to those above, are undertaken.

General

In some embodiments, additional information supplied by the driver to initialise the control system can be type of tyres, e.g. summer or winter. The type of tyres can affect maximum speeds depending on weather conditions. In some embodiments, the additional information can include weight of the truck. Weight may limit emergency stopping distance and hence the maximum safe speed of the truck.

In some embodiments, the transmitter-receiver units use WLAN or some other radio protocol, rather than Bluetooth.

In some embodiments, the interface to the cruise control system is the driver herself/himself. The driver then controls by hand the cruise control system.

In some embodiments, there is no separate radar distance detector; rather, distances may be calculated by measuring the radio transmission times of radio signals sent between transmitter-receiver units of trucks.

In some embodiments, in addition to, or instead of the screen of the human interface, the human interface includes a voice output, such as a loudspeaker, to provide information to, or ask questions of, the driver.

In some embodiments, the connections between the processor and transmitter-receiver units of the control system of a truck can be cabled. In some embodiments, they are wireless connections.

In some embodiments, the processor may also function as, or be, a satellite-navigation system, Personal Digital Assistant, Truck toll System "Toll Collect" on-board unit, or other on-board computer.

In some embodiments, the truck speed detector of a GPS module is replaced by some other known speed detector, usually one that is more accurate than the conventional speedometer of the truck.

Some embodiments relate to land vehicles other than or in addition to trucks. Other embodiments relate to sea, air and/or space vehicles.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A method, comprising:

a vehicle receiving by radio from another vehicle that is in front an indication of speed of said another vehicle, the vehicle detecting its own speed, automatically determining a speed adjustment to be effected by said another vehicle so as to control relative speed of the vehicles, transmitting by radio to said another vehicle a speed adjustment request to make the speed adjustment in which the vehicle requests that said another vehicle, which is in front, slows down for faster overtaking, calculating additional journey time of said another vehicle assuming the speed adjustment were made, and providing said additional journey time for display to the driver of said another vehicle.

2. A method according to claim 1, in which the radio is in accordance with Bluetooth protocol.

3. A method according to claim 1, in which the vehicles are on a multilane roadway, and are trucks or other motorised land vehicles.

4. A method according to claim 1, further comprising making the speed adjustment automatically.

5. A method according to claim 1, further comprising making the speed adjustment under driver control.

6. Vehicle speed control apparatus comprising:

for use in a vehicle at least one radio transmitter-receiver, a processor, a speed controller, and a speed detector, the processor being operative to:

receive data of speed of a vehicle from the speed detector;

receive data of speed of another vehicle that is in front of the vehicle, said data being received by the transmitter-receiver;

determine a speed adjustment to be requested of said another vehicle, said speed adjustment being a speed reduction; and the transmitter-receiver being operative to transmit the speed adjustment request;

the apparatus further comprising, for use in said another vehicle, a further speed controller, in which said further speed controller comprises a driver interface for displaying a speed adjustment command corresponding to the received speed adjustment request and to which the driver of said another vehicle can respond by effecting adjustment of vehicle speed, the speed adjustment command including data of additional journey duration.

7. Vehicle speed control apparatus according to claim 6, in which a speed adjustment to be requested of said another vehicle is determined and the transmitter-receiver is operative to transmit the speed adjustment request.

8. Vehicle speed control apparatus according to claim 6, in which the processor is also operative to determine a speed adjustment to be made by the vehicle; and the speed controller is operative to receive a speed adjustment control signal from the processor and adjust speed of the vehicle in consequence.

9. Vehicle speed control apparatus according to claim 8, in which the speed controller comprises a cruise control system operative to automatically respond to the speed adjustment control signal to adjust speed.

* * * * *